US007673744B1

(12) United States Patent
Henderson

(10) Patent No.: US 7,673,744 B1
(45) Date of Patent: Mar. 9, 2010

(54) JEWELRY TRAVEL CASE

(76) Inventor: Debbie Henderson, 6722 Gentry Ave., North Hollywood, CA (US) 91606

( * ) Notice: Subject to any disclaimer, the term of this patent is extended or adjusted under 35 U.S.C. 154(b) by 221 days.

(21) Appl. No.: 11/903,247

(22) Filed: Sep. 21, 2007

(51) Int. Cl.
*A45C 11/04* (2006.01)
*B65D 73/00* (2006.01)

(52) U.S. Cl. ..... 206/6.1; 206/473

(58) Field of Classification Search ..... 206/6.1, 206/566, 472–473; 211/85.2; 312/204, 245
See application file for complete search history.

(56) References Cited

U.S. PATENT DOCUMENTS 1,456,613 A * 5/1923 Bartels ..... 206/566
1,769,827 A * 7/1930 Dugdale ..... 206/566
2,813,622 A * 11/1957 Lancellotti ..... 206/6.1
4,287,986 A * 9/1981 Beck ..... 206/472
4,413,736 A * 11/1983 Nibling ..... 206/566
4,735,246 A * 4/1988 Niehaus ..... 206/6.1
4,848,585 A * 7/1989 Snyder ..... 206/566
5,219,071 A * 6/1993 Knapp ..... 206/6.1
5,671,849 A * 9/1997 Bacon ..... 211/85.2
5,692,605 A * 12/1997 Lai ..... 206/6.1
5,931,319 A * 8/1999 Murphy ..... 211/85.2
2005/0093405 A1* 5/2005 Greiner ..... 312/321.5
2006/0180481 A1* 8/2006 McGaughey, Sr. ..... 206/6.1

* cited by examiner

*Primary Examiner*—Bryon P Gehman
(74) *Attorney, Agent, or Firm*—Roy L Anderson; Wagner, Anderson & Bright, LLP

(57) ABSTRACT

A jewelry travel case has two halves connected by a hinge and closure mechanism. A first half has an inner compartment with a first pair of straps positioned toward its top side for releaseably engaging and holding one or more necklaces, including Omega-style necklaces, and a second pair of straps positioned between the first pair of straps and a pocket for releaseably engaging and holding one or more bracelets so that necklaces and bracelets will hang in the inner compartment when the case is vertical. A second half has an inner compartment with an earring bar releaseably secured to its upper portion and a ring bar releaseably secured to its lower portion. The earring bar can be detached at both of its ends so that it can be removed and has openings for holding earrings. The ring bar's substantially circular cross section provides tension to the pocket.

16 Claims, 4 Drawing Sheets

JEWELRY TRAVEL CASE

FIELD OF THE INVENTION

The present invention is in the field of jewelry cases used for traveling.

BACKGROUND OF THE INVENTION

Jewelry boxes and containers for jewelry are well known. They can be used to protect jewelry, to organize jewelry and to display jewelry.

The present invention is not concerned with jewelry display cases such as what might be used to display a variety of jewelry pieces for sale, such as what might be used by a jewelry wholesaler or jewelry salesperson. Instead, the present invention is directed to a personal jewelry case that can be used by a consumer who wants to take a variety of different pieces of jewelry away from a home, such as on a trip. As such, the present invention is not so concerned with display aspects of the jewelry case (except so as to allow its user to readily view and access its contents), but with practical issues arising from transporting personal jewelry in a convenient and inexpensive fashion that still provides protection and organization for the individual pieces of jewelry.

SUMMARY OF THE INVENTION

The present invention is generally directed to a jewelry travel case with two halves connected by a hinge and closure mechanism, one of the halves having an inner compartment with a first pair of straps positioned toward its top side for releaseably engaging and holding one or more necklaces so they will hang when the case is vertical in an upright position while the other half has an inner compartment with an earring bar releaseably secured to its upper portion and a ring bar releaseably secured to its lower portion.

In a first, separate group of aspects of the present invention, the inner compartment for holding necklaces also has a second pair of straps positioned between the first pair of straps and a pocket for releaseably engaging and holding one or more bracelets so that necklaces and bracelets will hang in the inner compartment when the case is vertical and the ring bar (which has a substantially circular cross section) will provide tension to the pocket.

In another, separate group of aspects of the present invention, the ring bar can be detached at both of its ends so that it can be removed, the first pair of straps accommodate a vertical hang of an Omega-style necklace and there is clearance of approximately 3 or more inches between the earring bar and the ring bar, the earring bar has a plurality of openings for holding a plurality of earrings, the two compartments have a substantially square shape with rounded edges and the two halves have a metal shell.

Accordingly, it is a primary object of the present invention to provide an improved jewelry travel case.

This and further objects and advantages will be apparent to those skilled in the art in connection with the drawings and the detailed description of the preferred embodiment set forth below.

DETAILED DESCRIPTION OF THE INVENTION

The present invention will now be discussed in connection with preferred embodiments illustrated in FIGS. 1-4.

In the Figures and the following more detailed description, numerals indicate various features of the invention, with like numerals referring to like features throughout both the drawings and the description. Although the Figures are described in greater detail below, the following is a glossary of the elements identified in the Figures.

Figure 1:
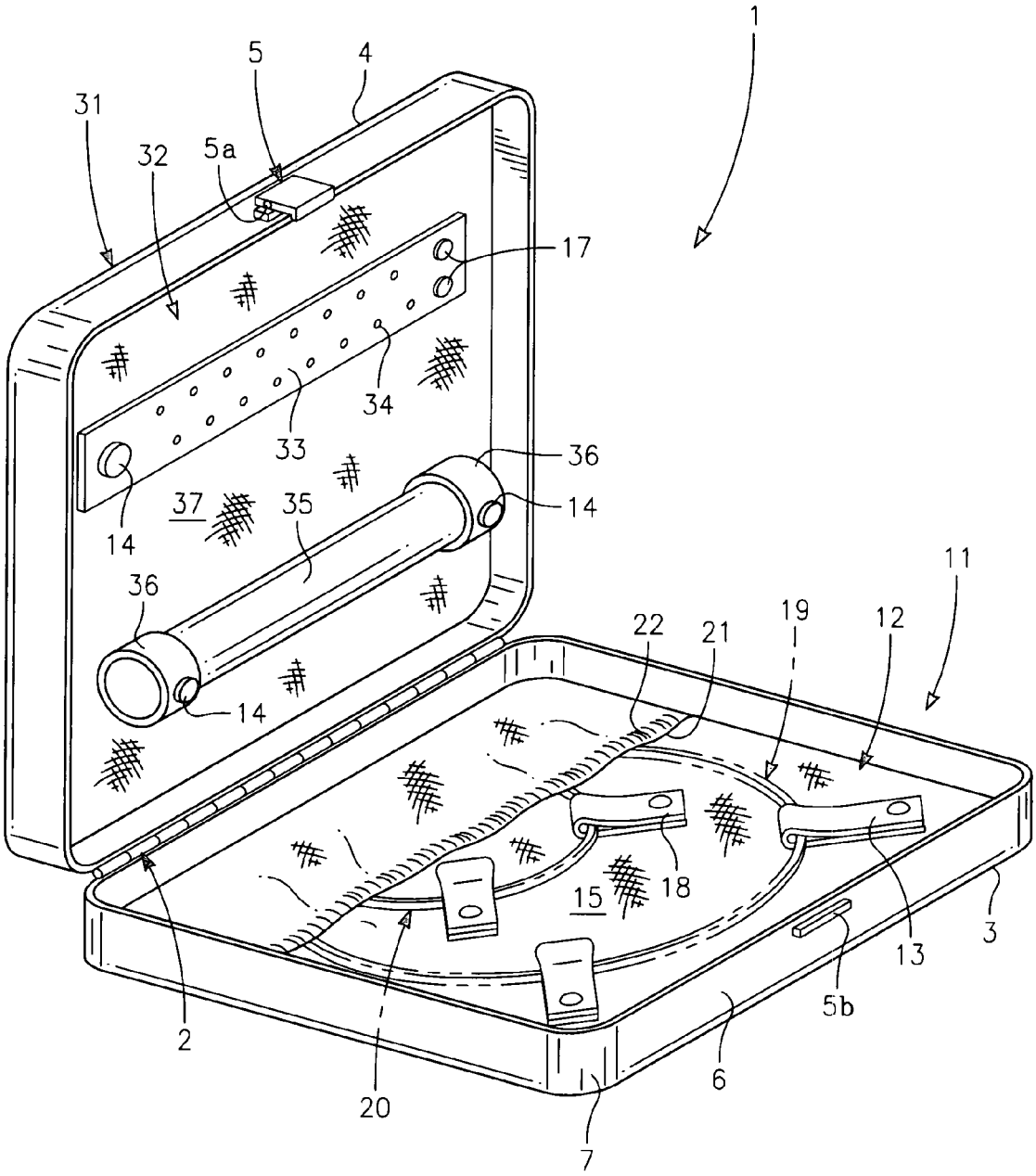
FIG. 1 is a view of a preferred embodiment of a jewelry travel case of the present invention when the case is open and the parts of the case are at a substantially ninety degree angle relative to each other.

1 jewelry travel case
2 hinge
3 bottom side
4 top side
5 closure mechanism
5*a* closure clasp mechanism
5*b* closure inset
6 outer surface
7 radius corner
8 metal case wall
9 inner sheet metal
10 foam layer
11 first half
12 first inner compartment
13 upper tab
14 snap
14*a* female snap opening
14*b* male snap end
15 first inner compartment fabric covering
16 opening in fabric 15
17 rivet
18 lower tab
19 omega style necklace
20 bracelet
21 pocket
22 gathered elastic top of pocket 21
31 second half
32 second inner compartment
33 earring bar
34 hole
35 circular ring bar
37 second inner compartment fabric covering A jewelry travel case 1 is illustrated in FIG. 1 in a partially open state. The case has a first half 11 with a first inner compartment 12 and a second half 31 with a second inner compartment 32. The two halves 11 and 12 of case 1 are held together along their bottom sides 3 by at least one hinge 2 (which may be of a piano hinge style) so that both halves can be laid flat on a flat surface when case 1 is opened so as to allow access to both inner compartments 12 and 32. Any suitable closure mechanism(s) 5 (such as, for example, a closure clasp mechanism 5*a* and a closure inset 5*b*) can be included on top sides 4 of halves 11 and 12 to close case 1.

It is especially preferred that case 1 has a hard shell, such as metal. A hard shell keeps its shape, as opposed to a soft shell, and thus keeps the space of inner compartments 12 and 32 intact when case 1 is closed. To the extent that case 1 has linear sides that meet in an angle (such as for a square case), it is preferred that the edges be rounded.

Figure 2:
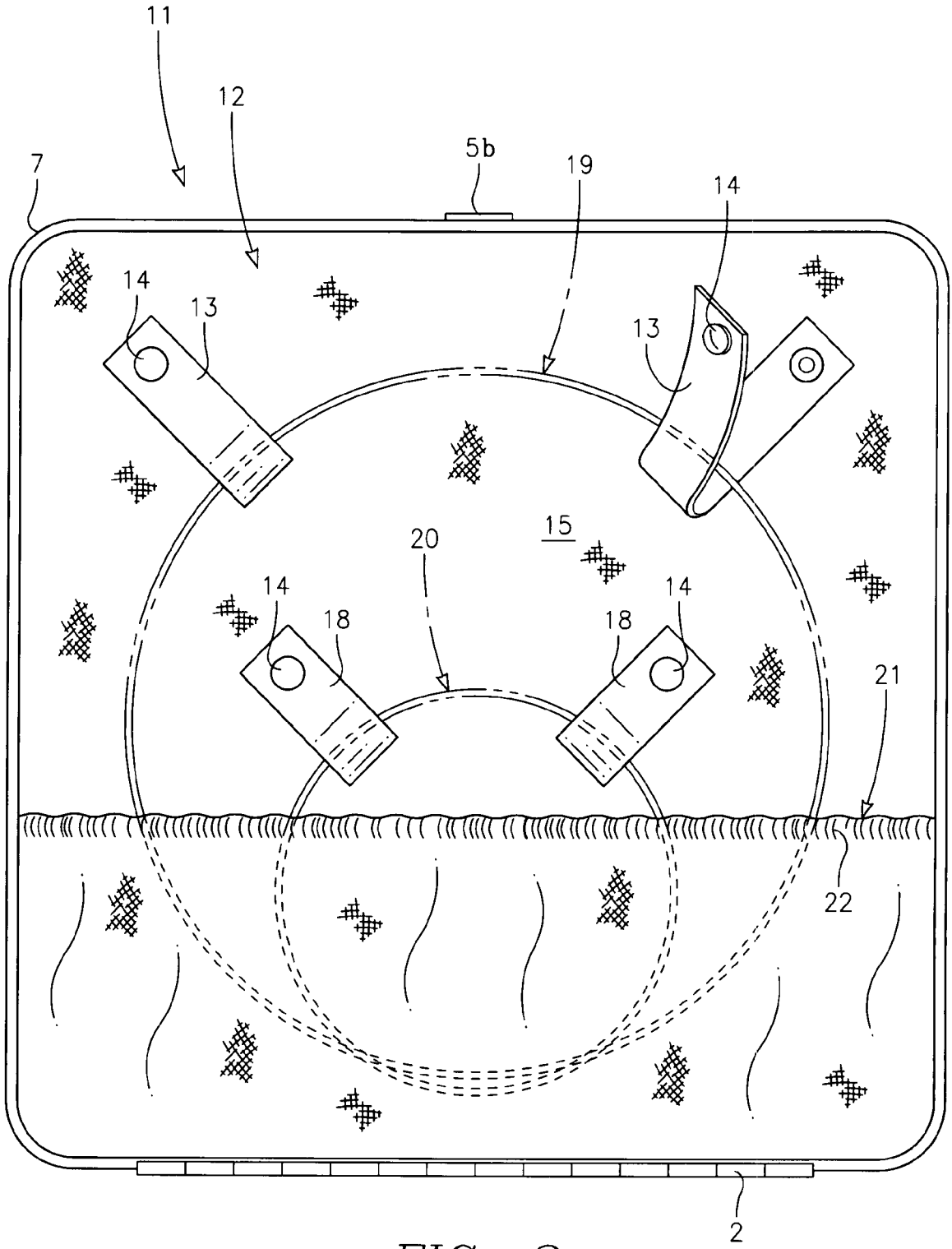
FIG. 2 illustrates an inner view of a first half of the jewelry travel case of FIG. 1 designed for holding necklaces and bracelets.
Figure 3:
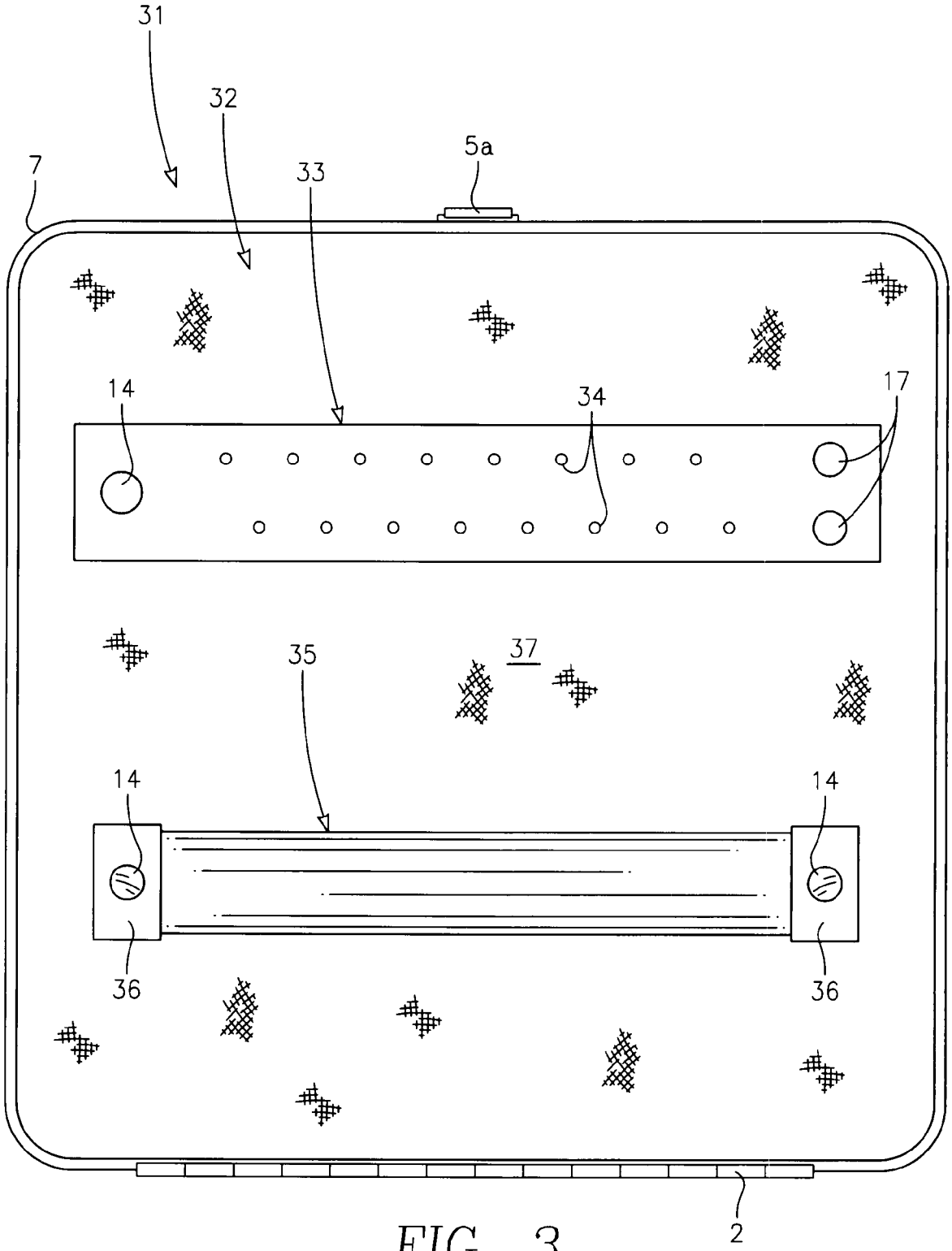
FIG. 3 illustrates an inner view of a second half of the jewelry travel case of FIG. 1 designed for holding earrings and rings.
Figure 4:
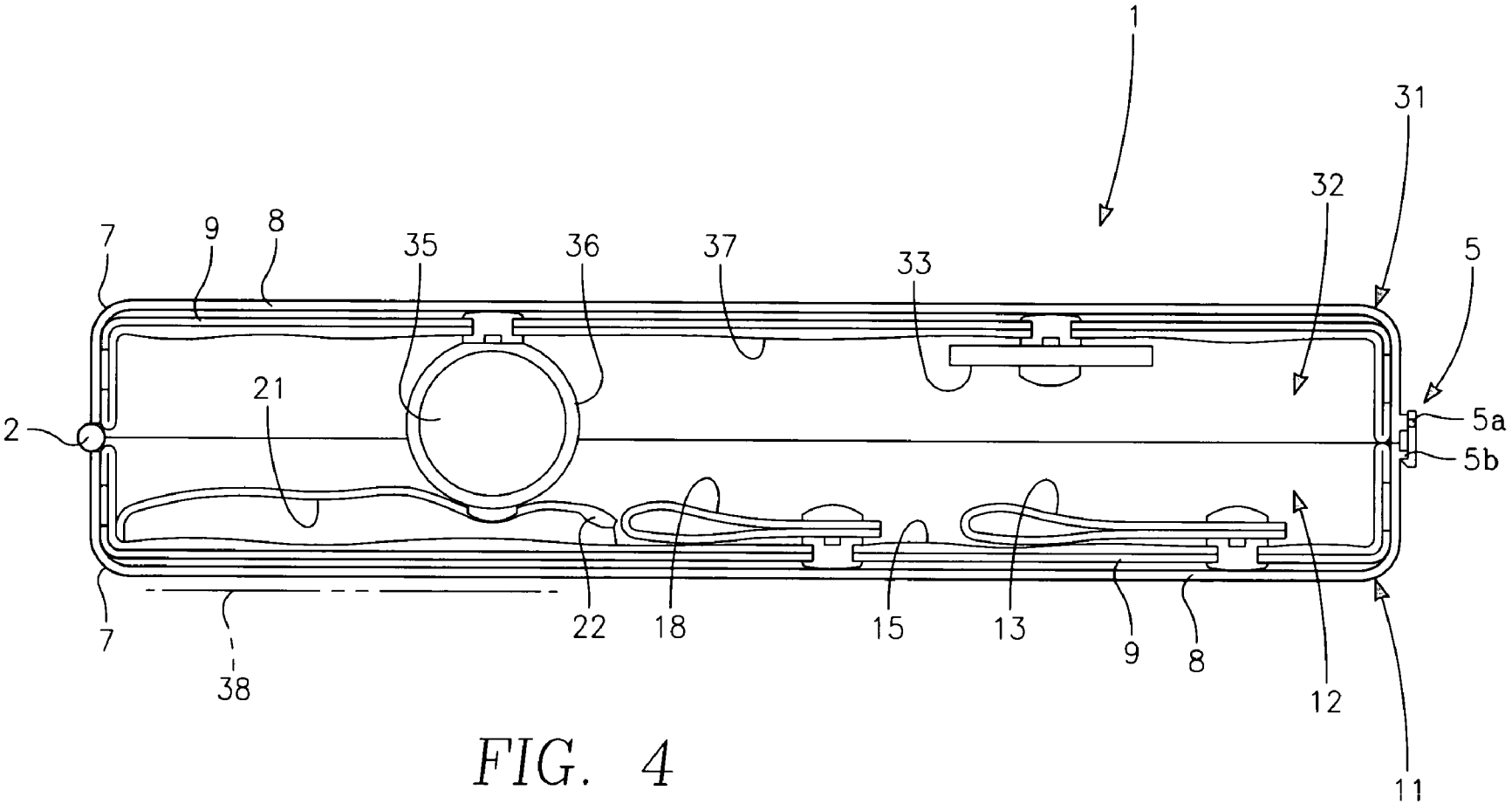
FIG. 4 is a cross-sectional view of a closed jewelry travel case of FIG. 1.

It is also especially preferred that case 1 be shaped so as to provide a substantially square cross section for inner compartments 12 and 32 (as depicted in FIGS. 2 and 3). The reason why a substantially square cross section for inner compartments 12 and 32 is especially preferred, as opposed to a common rectangular shape, is that such a shape readily accommodates omega-style necklaces that have a circular or oval shape and which retain that shape when they are hung (as opposed to necklaces which take on a linear shape if they are hung from a single point such as, for example, a push pin).

Inner compartment 12 of first half 11 is designed for holding necklaces and bracelets. As shown in FIG. 2, two upper tabs 13 with snap closures 14 are provided for retaining necklaces while two lower tabs 18 with snap closures 14 are provided for retaining bracelets. Tabs 13 and 18 can be made of fabric or leather and are diagonally oriented to provide support for hanging round necklaces and bracelets, respectively, with upper tabs being located closer to top side 4 and more towards the corners of inner compartment 12 than lower tabs 18. The ends of tabs 13 and 18 with female snap opening 14*a* are affixed to an inner sheet metal layer 9 by a rivet 17 and inner sheet metal layer 9 is bonded to metal case wall 8 (see FIG. 4) for stronger support. A pocket 21 with a gathered elastic top 22 is provided beneath lower tabs 18 (relative to top side 4) to hold in hanging necklaces and bracelets. Accordingly, it is seen that inner compartment 12 provides a handy and readily accessible organization for hanging necklaces and bracelets, including necklaces and bracelets that retain shape when they are hanging (such as omega style necklaces and solid bracelets).

Inner compartment 32 of second half 31 is designed for holding earrings and rings. As shown in FIG. 3, an earring bar 33 with pierced holes 34 is provided for retaining earrings while a circular ring bar 35 is provided for retaining rings. It is especially preferred that earring bar 33 is specifically designed to accommodate the hang of long dangle earrings (up to 3 inches) or large hoops and chandelier earrings as well as traditional studs. Earring bar 33 is positioned relative to top side 4 so that it has a hang length that can accommodate even larger dangles and/or hoops by placing them around the entire earring bar 33 rather than placing their ends in pierced holes 34. It is especially preferred that ring bar 35 be accessible from both of its sides, and removable, which is accomplished in the embodiment shown in FIG. 3 by retaining ring bar 35 in place by two tabs 35 with snaps 14. It is also especially preferred that ring bar 35 be located and sized so that it holds the bottom portions of necklaces and bracelets hanging in inner compartment 12 in place when case 1 is closed by resting against and providing tension to pocket 21 (see FIG. 4). This same orientation also provides additional hang room for larger items retained by earring bar 33 and creates an orientation in which, once case 1 is closed and is sitting upright on its bottom side 3, necklaces and bracelets hanging in first compartment 12 face earring bar 33 in second inner compartment 32 so that all hanging items in first and second compartments 12 and 32 hang in the same direction.

The present invention will now be described in even greater detail by describing an especially preferred embodiment designed to be marketed under the trademark Jewelry Traveler; however, it should be recognized that the specific dimensions and characteristics of the following especially preferred embodiment are provided simply for illustrative purposes and are not intended to limit the scope of the invention already set forth or defined by the claims that follow.

The Jewelry Traveler in its closed position is a 7 inch by 7 inch square footprint, by approximately 1 and ⅝ inches in depth, hard-sided, metal construction case with radius corners and attached on the bottom center with a metal piano-type hinge and a metal button/release closure clasp connection at the top. It its open position, the footprint of each side is a 7 inch by 7 inch metal square, by a ¾ inch depth with radius corners.

The first inner compartment 12 of The Jewelry Traveler has diagonally hanging fabric/leather upper tabs 13 with a snap closure approximately 1 inch from its top corners. The material in tabs 13 is 3 inches in length by ½ inch in depth when open and approximately 1½ inches in its snapped closed position. Below upper tabs 13 are another diagonally oriented set of hanging fabric/leather lower tabs 18 with a snap closure approximately 3¼ inches from top side 4. Lower tabs 18 are 2½ inches in length by ½ in depth when open and approximately 1¼ in its snapped closed position. Covering the bottom 2¾ by 7 inches of the square is an attached fabric pocket 21 with gathered elastic at the top. All snaps and rivets attach to the base snap/rivet in sheet metal 9 attached to foundation metal case wall 8.

The second inner compartment 32 of The Jewelry Traveler has an earring bar 33 starting 1½ inches from the top of the square. It is a 6×1 inch of fabric/leather including ¾ inch fabric/leather end caps with a snap on the its West side and two secured rivets on the East side. Earring bar 33 is pierced with holes to accommodate earrings of all orientations and sixteen pierced holes are spaced ½ inch apart along the middle approximately 4 inch section. Below earring bar 33, and 4½ inches from the top of the square, is a ¾ inch circumference, padded and circular ring bar 35. The fabric and padded ring bar 35 is 4 inches long in its tube form and then becomes flat when secured on both sides by ¾×¾ fabric/leather strap with a snap on each of the West and East ends. All naps and rivets attach to the base snap/rivets in sheet metal 8 attached to foundation metal case wall 8.

Both the first and second halves 11 and 31 of The Jewelry Traveler™ exterior 7×7×¾ inch metal casings can be completely covered in a variety of ways, such as powder coating in a variety of colors or finishes or covered with thin foam adhered to the metal casing with various fabrics, vinyl, leather, micro-suede or other fabric adhered on top of the foam for a padded, decorative finish. The treatment will completely cover any exposed metal with the exception of the external hinge and the closure mechanisms.

Both sides of the interior 7×7×¾ inch metal casings are first fitted with an approximate 6½×6½ inch square piece of thinner sheet metal which serves as the base host for the bottom portions of the rivets and the snaps. The thinner sheet metals are bonded to the base metal casing for stronger support for a quality snap system on the interior.

The final treatment for the interior of The Jewelry Traveler™ is designed to cover and conceal all interior metal layers. It is a single piece, pre-fabricated, custom molded, thin plastic, fitted liner that is flocked in a velvet-type flocking and fits into place on top of the base host snap layer. It is adhered to the interior, thus sealing the metal layers. This molded liner is formed specifically for the 7×7×¾ inch footprint on each side of the hinge with a "bridge" over the metal hinge on the interior, both concealing the hinge from the inside as well as protecting the user from the movement of the hinge. The interior lining will have scores for base snaps and rivets to protrude into the interior, exposing them to their counterparts on the inside components. The 2¾×7 inch fabric pocket with its gathered elastic at the top is sewn in place directly onto this plastic layer.

While the invention has been described herein with reference to certain preferred embodiments, those embodiments have been presented by way of example only, and not to limit the scope of the invention. Additional embodiments and further modifications are also possible in alternative embodiments that will be obvious to those skilled in the art having the benefit of this detailed description. For example, if desired, a jewelry travel case in accordance with the present invention could be made in a variety of shapes other than square, such as triangular, hexagonal or octagonal, all of which can be designed so that they have two opposing inner compartments having a substantially square shape to accommodate hanging necklaces and bracelets on one side with hanging earrings and a ring bar on the opposing side, the orientation of which would be substantially the same as already described and shown in the Figures for a square travel case.

Accordingly, still further changes and modifications in the actual concepts described herein can readily be made without departing from the spirit and scope of the disclosed inventions as defined by the following claims.

What is claimed is:

1. A jewelry travel case, comprising:

a first half having a first inner compartment;

a pocket formed in the first inner compartment for enclosing a bottom portion of one or more necklaces when they are hanging from the first pair of straps;

a second half having a second inner compartment;

a hinge connecting the first and second halves at a bottom side;

a closure mechanism located at a top side of the first and second halves for releaseably closing the first and second halves together when the closure mechanism is in a closed state and for allowing the first and the second halves to open outwardly from each other to allow access to the first and second inner compartments when the closure mechanism is in an open state;

a first pair of straps positioned toward the top side of the first inner compartment for releaseably engaging and holding one or more necklaces so that they will hang in the first inner compartment when the first half is positioned so that the top and bottom sides are substantially vertical;

a ring bar releaseably secured to a lower portion of the second inner compartment; and an earring bar releaseably secured to an upper portion of the second inner compartment;

wherein the ring bar has a substantially circular cross section over a length of said ring bar for holding rings; and wherein the substantially circular cross section is located such that it will provide tension to the pocket when the travel case is in the closed state.

2. The jewelry travel case of claim 1, wherein the ring bar is detachable at both a first end and a second end so that it can be removed from the second inner compartment.

3. The jewelry travel case of claim 1, further comprising:

a second pair of straps positioned between the first pair of straps and the bottom side of the first inner compartment for releaseably engaging and holding one or more bracelets so that each bracelet will hang in the first inner compartment when the first half is positioned so that the top and bottom sides are substantially vertical.

4. The jewelry travel case of claim 1, wherein the first and second compartments have a substantially square shape.

5. The jewelry travel case of claim 4, wherein the substantially square shape of the first and second halves have four rounded edges.

6. The jewelry travel case of claim 4, wherein the first pair of straps accommodates a vertical hang of an omega-style necklace.

7. The jewelry travel case of claim 1, wherein the earring bar has a plurality of openings for holding a plurality of earrings.

8. A hard shell jewelry travel case, comprising:

a first half having a first inner rigid compartment with a substantially square first cross section;

a second half having a second inner rigid compartment with a substantially square second cross section;

a hinge connecting the first and second halves at a bottom side;

a closure mechanism located at a top side of the first and second halves for releaseably closing the first and second halves together when the closure mechanism is in a closed state and for allowing the first and the second halves to open outwardly from each other to allow access to the first and second inner compartments when the closure mechanism is in an open state;

a first pair of straps positioned toward the top side of the first inner compartment for releaseably engaging and holding one or more necklaces so that they will hang in the first inner compartment when the first half is positioned so that the top and bottom sides are substantially vertical;

a second pair of straps positioned between the first pair of straps and the bottom side of the first inner compartment for releaseably engaging and holding one or more bracelets so that they will hang in the first inner compartment when the first half is positioned so that the top and bottom sides are substantially vertical;

a pocket formed in the first inner compartment for enclosing a bottom portion of one or more necklaces and one or more bracelets when they are hanging from the first and second pair of straps, respectively;

a ring bar releaseably secured to a lower portion of the second inner compartment; and an earring bar releaseably secured to an upper portion of the second inner compartment;

wherein the ring bar has a substantially circular cross section over a length of said ring bar for holding rings; and wherein the substantially circular cross section is located such that it will provide tension to the pocket when the travel case is in the closed state.

9. The jewelry travel case of claim 8, wherein the ring bar is detachable at both a first and a second end so that it can be removed from the second inner compartment.

10. The jewelry travel case of claim 8, wherein the first pair of straps accommodates a vertical hang of an omega-style necklace.

11. The jewelry travel case of claim 8, wherein the earring bar has a plurality of openings for holding a plurality of earrings.

12. The jewelry travel case of claim 11, wherein there is clearance of approximately 3 or more inches between the earring bar and the ring bar.

13. The jewelry travel case of claim 8, wherein the first and second halves have a metal shell.

14. A jewelry travel case, comprising:

a first shell having a first inner compartment;

a pocket formed in the first inner compartment for enclosing a bottom portion of one or more necklaces when they are hanging from the first pair of straps;

a second shell having a second inner compartment;

a hinge connecting the first and second shells at a bottom side;

a closure mechanism for releaseably closing the first and second shells together when the closure mechanism is in a closed state and for allowing the first and the second shells to open outwardly from each other to allow access to the first and second inner compartments when the closure mechanism is in an open state;

a first pair of straps positioned toward the top side of the first inner compartment for releaseably engaging and holding one or more necklaces so that they will hang in the first inner compartment when the first half is positioned so that the top and bottom sides are substantially vertical; and a ring bar releaseably secured to a lower portion of the second inner compartment;

wherein the ring bar has a substantially circular cross section over a length of said ring bar for holding rings; and wherein the substantially circular cross section is located such that it will provide tension to the pocket when the travel case is in the closed state.

15. The jewelry travel case of claim 14, further comprising:

an earring bar releaseably secured to an upper portion of the second inner compartment.

16. The jewelry travel case of claim 14, further comprising:

a second pair of straps positioned between the first pair of straps and the bottom side of the first inner compartment for releaseably engaging and holding one or more bracelets so that each bracelet will hang in the first inner compartment when the first half is positioned so that the top and bottom sides are substantially vertical.

* * * * *